US005762347A

United States Patent [19]

Hilgarth

[11] Patent Number: 5,762,347

[45] Date of Patent: Jun. 9, 1998

[54] SYSTEM FOR THE LATERAL ADJUSTMENT OF THE SHOE AND SUPPORT FOR SKATES

[75] Inventor: Kurt Hilgarth, Graz-Sciersberg, Austria

[73] Assignee: Fancyform Design Engineering, Graz-Grambach, Austria

[21] Appl. No.: 831,089

[22] Filed: Apr. 1, 1997

[30] Foreign Application Priority Data

Apr. 1, 1996 [AT] Austria ..... 183/96
Dec. 20, 1996 [IT] Italy ..... UD96A0244

[51] Int. Cl.[6] ..... A63C 17/06

[52] U.S. Cl. ..... 280/11.22; 280/11.19; 280/11.27; 280/11.3

[58] Field of Search ..... 280/11.22, 11.27, 280/11.26, 11.23, 11.19, 11.12, 11.28, 841, 87.041, 87.042, 11.3

[56] References Cited

U.S. PATENT DOCUMENTS 5,046,746 9/1991 Gierveld ..... 280/11.22

FOREIGN PATENT DOCUMENTS 000 021 10/1994 Austria .

*Primary Examiner*—David M. Mitchell

*Attorney, Agent, or Firm*—Jacobson, Price, Holman & Stern, PLLC

[57] ABSTRACT

System for the lateral adjustment of the wheel chassis of a skate (14) located between a shoe (11) and a support (12) including a removable constraint made of connection element (16) arranged substantially transverse to the direction of advance of the skate which cooperates with at least one lower extension (17) of the shoe, at least one wing (18) of the support and a spacer element (19). The spacer element comprises at least two distinct lateral portions (19*a*, 19*b*) with thicknesses (s1, s2).

7 Claims, 1 Drawing Sheet

SYSTEM FOR THE LATERAL ADJUSTMENT OF THE SHOE AND SUPPORT FOR SKATES

Figure 1:
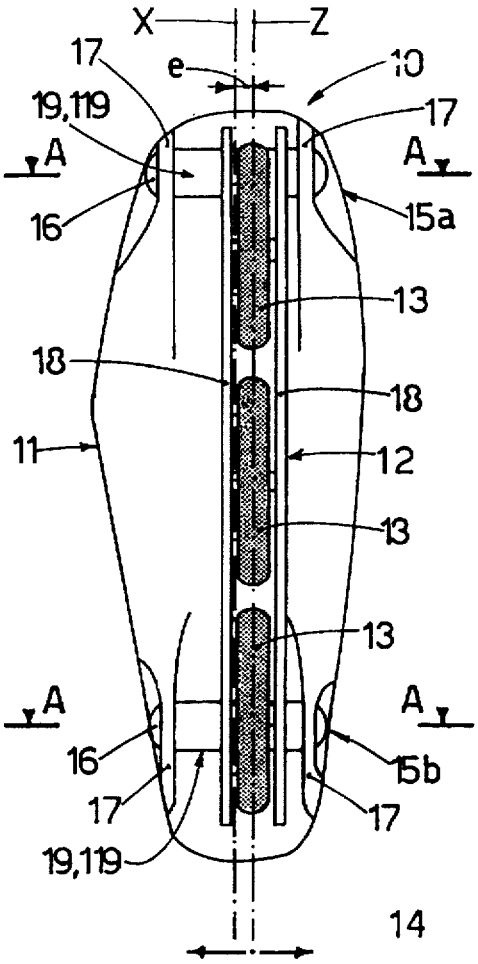

This invention concerns a system for the lateral adjustment of the shoe and the support for skates as set forth in the main claim.

The invention is applied to skates consisting of a shoe or casing associated with a support from which it can be removed and on which are mounted one or more skating elements such as wheels, blades or other.

The invention is used to reciprocally adjust the shoe and the support transversely to the direction of advance.

Skates known to the state of the art are substantially made of a casing or rigid or semi-rigid shoe associated with a support onto which are mounted the skating elements.

The continual evolution of sports activities which include the use of skates and the diversification of the skating elements used has emphasized the need to create a removable-type connection between the shoe and the support so as to be able to use a single shoe for different supports which are compatible with it.

Various solutions have been proposed for this type of skate, such as the inclusion of a lateral adjustment of the shoe with respect to the support with which it is associated.

This adjustment makes it possible to vary at least partly the conditions under which the skating elements rest on the shoe; these conditions may be adapted to the physical and morphological characteristics of the user, to the sporting activity involved and to the type of terrain.

This adjustment is particularly advantageous, for example, for fast skating on oval or ring-shaped circuits, where the skater always rounds the same type of bend (to the left or to the right).

U.S. Pat No. 5,046,746 discloses a removable support for skates which includes at the upper part a slot arranged transversely and cooperating with a screw element solid with the sole of the shoe.

The lateral adjustment of the shoe with respect to the support is obtained by sliding the screw element into the relative slot and clamping the combined shoe-support into the position thus assumed by means of a clamping nut.

This solution, however, is very limiting as the lateral adjustment is constrained to a single lengthwise position of the shoe with respect to the support and as it is possible to include only a minimal lateral, parallel displacement of the shoe with respect to the support.

AT-A-000 021 shows a lateral adjustment system for the shoe-support comprising one or more pins, solidly associated with the sole of the shoe, including a threaded bush inside which a mating screw element is inserted and passes transversely with respect to the support.

According to the adjustment of the screw elements, these pins slide sideways inside a slot made on the support, carrying the shoe with them as they move; the shoe thus varies its transverse position with respect to the support.

This lateral adjustment system, however, does not allow the concurrent longitudinal adjustment of the shoe-support combination, and therefore limits the range of configurations which may be assumed by the skate using this system.

Both these systems, moreover, do not permit precise adjustments to be obtained, as these adjustments are limited by the sensitivity of the user; therefore, when the reciprocal transverse position of the shoe and support is varied, it may then be difficult to restore the previous configuration.

Furthermore, when the skate is subjected to strong vibrations or mechanical stresses, the attachment and adjustment elements may become loose and this may cause the reciprocal transverse position of the shoe and support to change, and therefore the desired configuration of the skate may also be lost.

The present applicants have designed, tested and embodied this invention to overcome the shortcomings of the state of the art, and to obtain further advantages.

This invention is set forth and characterised in the main claim, while the dependent claims describe variants of the idea of the main embodiment.

The purpose of the invention is to provide a system to perform a simple, speedy and precise variation of the reciprocal lateral position of the shoe and the support of the skate.

A further purpose of the invention is to embody a system to stably maintain the reciprocal position of the shoe and the support even when the skate is subjected to maximum stress.

Another purpose of the invention is to provide a system which neither impedes nor obstructs any possible adjustments in a lengthwise direction of the shoe with respect to the support.

Yet another purpose is to provide a lateral adjustment system which does not require any auxiliary work to be done on the structure of the skate or any part thereof in order for the said system to be embodied.

The invention is applied to skates where the constraint between shoe and support is obtained by means of connection elements, for example one or more pins, arranged transversely with respect to the direction of advance of the skate.

The connection elements constrain the shoe and the support in an unmovable manner, associating stably one or more lower extensions of the shoe to one or more wings of the support.

The lower extensions and support wings are arranged on a substantially perpendicular plane to the horizontal plane of the shoe.

The invention is applied in particular, but not exclusively, to those cases where two lower extensions of the shoe cooperate, either outside or inside, with two blades of the support.

The invention can also be used in cases where two lower extensions of the shoe cooperate with a single blade of the support, or where a lower extension cooperates with two blades of the support.

As a last application, the invention can also be applied where a single lower extension of the shoe cooperates with a single blade of the support.

The invention is applied to skates where the lower extensions of the shoe and the wings of the support constrained to them define a desired area of reciprocal lateral play.

According to the invention, spacer elements of variable thickness are arranged between the shoe and the support in correspondence with the connection elements.

According to their conformation, number and thickness, the spacer elements cause the lateral positioning of the shoe with respect to the support to be centred or offset.

To be more exact, the spacer elements are inserted between the lower extensions of the shoe and the wings of the support, thus occupying and filling the area of lateral play between the extensions and the wings.

If the area of lateral play is occupied by spacers of equal thickness on both sides, then the positioning of the shoe and support is reciprocally centred; if the area of lateral play is occupied by spacers of different thickness, then the positioning of the shoe and the support is offset.

According to a first embodiment of the invention, the spacer element is made in a single body, it is associated coaxially with the connection element between the shoe and the support and includes at least a slot where the blades of the support or of the lower extensions of the shoe can be inserted.

The at least one insertion slot defines the two lateral portions of the spacer element; the thickness, equal or different, of the spacer element determines respectively the position, either reciprocally centred or offset of the shoe and support.

According to another embodiment, a spacer element is used which is made of a plurality of complementary elements which, all together, occupy the area of lateral play between the extensions of the shoe and the blades of the support.

The lateral adjustment system according to the invention is extremely simple and speedy.

The system allows the shoe and support to be displaced laterally and in parallel, when the offset position is obtained in all the constraint seatings of the shoe and the support; it also allows an oblique lateral displacement when the offset position is achieved in correspondence with only one of the constraint seatings.

In order to perform the lateral adjustment of the skate, the user has only to dissociate the shoe from the support and replace the spacer element or elements with others of a different thickness, or invert the positioning of the spacer elements.

It is possible to maintain the configuration of the skate even in conditions of maximum stress, since any lateral translation of the shoe and support is prevented by the spacer elements which entirely compensate for the play between the lower extensions of the shoe and the wings of the support.

It is also simple and quick to return to a previous configuration, when so desired, as it is sufficient to reuse the same spacer elements used previously in the arrangement corresponding to the original configuration.

The lateral adjustment system according to the invention does not depend on the longitudinal position of the shoe with respect to the support, and this increases the versatility of the skate to which it is applied.

Figure 2:
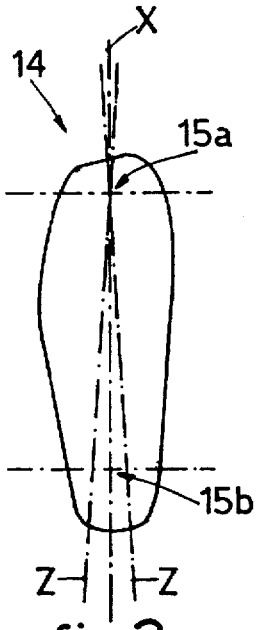
Figure 2A:
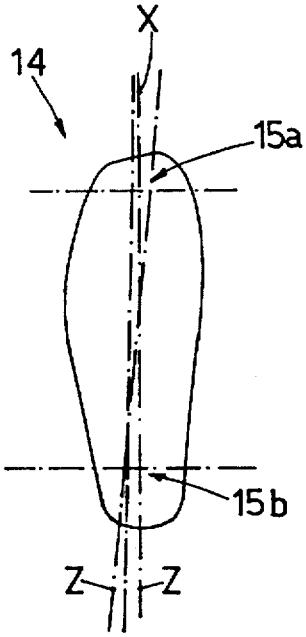
Figure 4:
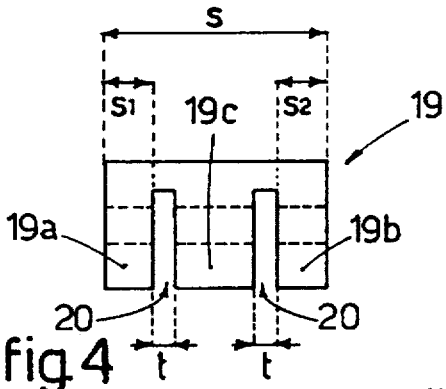
Figure 3:
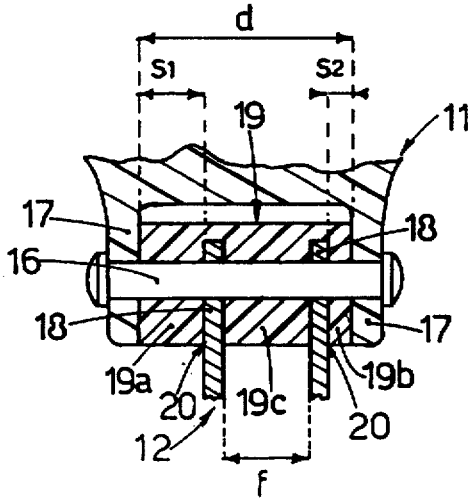
Figure 3A:
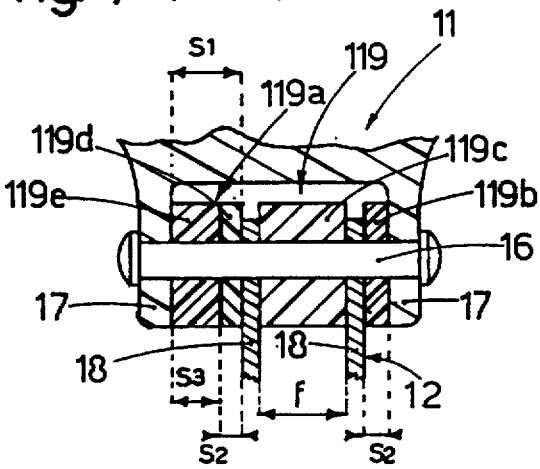

The attached figures are given as a non-restrictive example and show some preferred embodiments of the invention as follows:

FIG. 1 shows a view from below of a skate adopting the lateral adjustment system for the shoe and support according to the invention;

FIGS. 2, 2*a* show two different diagrams of the oblique lateral adjustment of the skate in FIG. 1;

FIG. 3 shows a section from "A" to "A" of FIG. 1;

FIG. 3*a* shows a different embodiment of the invention;

FIG. 4 shows a possible embodiment of a spacer element according to the invention.

With reference to the attached figures, the number 10 denotes generally the system of lateral adjustment of the shoe 11 and the support 12 for skates 14 according to the invention.

In this case, the skate 14 is of the type with aligned wheels and consists of a rigid shoe 11 constrained in two seatings, the forward seating 15*a* and the rear seating 15*b*, to the support 12 on which are mounted three skating elements 13 consisting of wheels.

The invention is also applied to skates 14 with four or more wheels.

The constraint between the shoe 11 and the support 12 is achieved by means of connection elements 16, in this case screw elements, arranged transversely with respect to the direction of advance of the skate 14.

These connection elements 16 are inserted into mating through holes made on the lower extensions 17 of the shoe 11 and on the wings 18 of the support 12.

In cooperation with the connection elements 16, in correspondence with at least one of the constraint seatings, either the forward 15*a* or the rear 15*b*, in this case in both, there are spacer elements 19, 119 placed between the lower extensions 17 and the wings 18.

The spacer elements 19, 119 are arranged in such a way that they completely occupy the free space which is created between the lower extensions 17 and the wings 18, and fill both the outer area of play between extensions 17 and wings 18 and also the inner area of play between the wings 18.

According to the thickness, the number and/or the arrangement of the spacer elements 19, 119, the shoe 11 and the support 12 assume a reciprocal position where their median vertical planes, respectively "X" and "Z", are coincident, parallel (FIG. 1) or intersecting (FIGS. 2, 2*a*)

According to a first embodiment of the invention, shown in FIGS. 3 and 4, the spacer element is made in a single body 19.

According to another embodiment shown in FIG. 3*a*, the spacer element 119 is made of a plurality of complementary spacer elements.

In the example shown in FIGS. 3 and 4, the spacer element 19 has an overall transverse size "s" which substantially coincides with the distance "d" between the two lower extensions 17 of the shoe 11.

The spacer element 19 moreover includes two seating slots 20, of a thickness "t" which substantially coincides with that of the wings 18, inside which the wings 18 are inserted, and are thus laterally contained between the portions 19*a*, 19*b*, 19*c* of the spacer element 19.

The first lateral portion 19*a* and the second lateral portion 19*b* define the reciprocal position of the shoe 11 and the support 12 by being positioned between the wings 18 of the support 12 and the lower extensions 17 of the shoe 11.

The central portion 19*c*, of a thickness which substantially coincides with the distance "f" between the wings 18 of the support 12, functions as a filling and stiffening element.

Moreover, during the assembly operations, the central portion 19*c* prevents the tightening of the connection elements 16 from causing a deformation of the wings 18 of the support 12.

According to whether the thickness "s1", "s2", of the first lateral portion 19*a* and the second lateral portion 19*b* of the spacer element 19 is the same or different, the shoe 11 and the support 12 are centred or offset.

In the example shown in FIG. 3, the thickness "s1" of the first lateral portion 19*a* of the spacer element 19 is greater than the thickness "s2" of the second lateral portion 19*b*, and therefore when it is used in correspondence with both the constraint seatings 15*a*, 15*b*, it defines an eccentricity "e" between the shoe 11 and the support 12 (FIG. 1).

In FIG. 4 the relative thicknesses "s1", "s2" of the lateral portions 19*a*, 19*b* of the spacer element 19 are equal, and therefore when the spacer element 19 is used in correspondence with both the constraint seatings 15*a*, 15*b* it causes the reciprocal position of the shoe 11 and the support 12 to be centred.

It is obvious that, if in correspondence with a constraint seating, for example 15*a*, a spacer element is used of the type shown in FIG. 3, and in correspondence with the other constraint seating 15*b* a spacer element is used of the type shown in FIG. 4, then the skate 14 will have a configuration where the shoe 11 and the support 12 are reciprocally oblique.

The variant shown in FIG. 3*a* uses a spacer element 119 consisting of a plurality of elements, in this case 119*a*, 119*b* and 119*c*, which are complementary and arranged between wings 18 of the support 12 and lower extensions 17 of the shoe 11.

The outer spacer elements 119*a*, 119*b* are arranged respectively between one wing 18 of the support 12 and the relative extension 17 of the shoe 11, while the central spacer element 119*c* is arranged in an intermediate position between the wings 18 and functions as a filling and stiffening element.

According to the different transverse thickness "s1" and "s2" of the outer spacer elements 119*a* and 119*b*, the shoe 11 and the support 12 assume a centred, or offset, configuration.

In the preferred embodiment shown, the outer spacer element 119*a* is in turn composed of two elements 119*d* and 119*e*.

The spacer element 119*d* has a thickness "s2" equal to that of the spacer element 119*b*, while the spacer element 119*e* has a thickness "s3" which is twice that of "s2" of the spacer elements 119*b* and 119*d*.

By using this simple configuration, in order to obtain a centred position of the shoe 11 and the support 12, compared with the offset position shown in FIG. 3*a*, it is sufficient to position the spacer element 119*d* next to the spacer element 119*b* in cooperation with the other lower extension 17.

This solution reduces the number of components necessary to obtain the two reciprocal positions between the shoe 11 and the support 12. All the components necessary are, moreover, always assembled on the skate 14.

According to a variant not shown here, one of the two outer spacer elements 119*a* or 19*b* is not included; in this case, the wing 18 of the support 12 rests directly on the relative lower extension 17 of the shoe 11, while on the other side a spacer element is used which is of the appropriate thickness to compensate for the lateral play which is created.

According to a further variant, spacer elements made in a single body 19 and spacer elements 119 made of separate elements are used together in combination.

I claim:

1. System of lateral adjustment between a shoe (11) and a support (12) of skates (14), the skates (14) including a constraint between the shoe (11) and the support (12) of the type that can be removed, the constraint being made of connection element (16) arranged substantially transverse to the direction of advance of the skate (14) and located in correspondence with at least one forward constraint seating (15*a*) and/or rear constraint seating (15*b*), the connection elements (16) cooperating with at least one lower extension (17) of the shoe (11) and at least one wing (18) of the support (12) defining reciprocal assembly portions, the assembly portions being arranged on a plane substantially perpendicular to the horizontal plane of the shoe (11), there being included between the at least one lower extension (17) and the at least one wing (18) a defined area of lateral play, the system being characterised in that it includes the use of at least one replaceable spacer element (19, 119) associated with the connection element (16) in cooperation with the at least one constraint seating (15*a*, 15*b*), the spacer element (19, 119) being placed between the at least one lower extension (17) and the at least one wing (18), the spacer element (19, 119) being at least of a first type defining a reciprocally centred position of the vertical median plane ("X") of the shoe (11) and the vertical median plane ("Z") of the support (12) and at least a second type defining an offset position between the planes ("X", "Z").

2. System as in claim 1, in which the spacer element (19) is made in a single body and comprises at least two distinct lateral portions (19*a*, 19*b*) with respective different thickness (S1,S2) of "s1", "s2", and at least an intermediate housing slot (20) where the wing (18) or support (12) is inserted.

3. System as in claim 1, in which the spacer element (119) consists of a plurality of separate elements comprising at least lateral spacer elements (119*a*, 119*b*) having respective different thicknesses (s1, s2, respectively arranged between a wing (18) of the support (12) and the relative lower extension (17) of the shoe (11).

4. System as in claim 2, in which the thicknesses ("s1", "s2",) of the lateral portions (19*a*,119*a*; 19*b*,119*b*) of the spacer elements (19, 119) of the first type are equal.

5. System as in any claim 2, in which the thicknesses ("s1", "s2") of the lateral portions (19*a*,119*a*; 19*b*,119*b*) of the spacer elements (19, 119) of the second type are different.

6. System as in claim 2, in which the spacer elements (19, 119) comprise at least a central portion (19*c*, 119*c*) functioning as a filling and stiffening element.

7. System as in claim 1, wherein said skate comprises aligned wheels.

* * * * *